US007425398B2

(12) United States Patent
Nosella et al.

(10) Patent No.: US 7,425,398 B2
(45) Date of Patent: Sep. 16, 2008

(54) SULFONATED POLYESTER TONER

(75) Inventors: Kimberly D. Nosella, Mississauga (CA); Guerino G. Sacripante, Oakville (CA); Allan K. Chen, Oakville (CA); Valerie M. Farrugia, Oakville (CA); Ke Zhou, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 489 days.

(21) Appl. No.: 11/239,168

(22) Filed: Sep. 30, 2005

(65) Prior Publication Data

US 2007/0077510 A1 Apr. 5, 2007

(51) Int. Cl.
*G03G 9/00* (2006.01)

(52) U.S. Cl. ..... 430/109.4; 430/110.2; 430/108.1; 430/137.14

(58) Field of Classification Search ..... 430/109.4, 430/110.2, 108.1, 137.14
See application file for complete search history.

(56) References Cited

U.S. PATENT DOCUMENTS

| | | | | |
|---|---|---|---|---|
| 3,590,000 | A | 6/1971 | Palermiti et al. | |
| 3,847,604 | A | 11/1974 | Hagenbach et al. | |
| 4,265,990 | A | 5/1981 | Stolka et al. | |
| 4,298,672 | A | 11/1981 | Lu | |
| 4,338,390 | A | 7/1982 | Lu | |
| 4,935,326 | A | 6/1990 | Creatura et al. | |
| 4,937,166 | A | 6/1990 | Creatura et al. | |
| 5,236,629 | A | 8/1993 | Mahabadi et al. | |
| 5,330,874 | A | 7/1994 | Mahabadi et al. | |
| 5,593,807 | A | 1/1997 | Sacripante et al. | |
| 5,919,595 | A | 7/1999 | Mychajlowskij et al. | |
| 6,020,101 | A | 2/2000 | Sacripante et al. | |
| 6,143,457 | A * | 11/2000 | Carlini et al. | 430/108.2 |
| 6,214,507 | B1 | 4/2001 | Sokol et al. | |
| 6,387,581 | B1 * | 5/2002 | Moffat et al. | 430/108.22 |
| 6,395,445 | B1 * | 5/2002 | Toth et al. | 430/137.14 |
| 6,780,560 | B2 | 8/2004 | Farrugia et al. | |
| 6,824,944 | B2 | 11/2004 | Sacripante et al. | |

OTHER PUBLICATIONS

U.S. Appl. No. 11/037,214, filed Jan. 19, 2005, Patel et al.
U.S. Appl. No. 11/094,428, filed Mar. 31, 2005, Farrugia et al.

* cited by examiner

*Primary Examiner*—Mark A Chapman
(74) *Attorney, Agent, or Firm*—Oliff & Berridge, PLC

(57) ABSTRACT

A toner of a sulfonated polyester resin and at least one colorant is made to contain from about 0.01% by weigh to about 3% by weight of dry toner in total of lithium, sodium, zinc and calcium. The sulfonated polyester resin may be an alkali metal sulfonated polyester resin, wherein the alkali metal may be sodium and/or lithium. The toner may be formed in an emulsion aggregation process in which an alkali (II) metal salt such as a zinc salt and/or a calcium salt is used as an aggregating agent.

21 Claims, No Drawings

SULFONATED POLYESTER TONER

RELATED APPLICATIONS

Application Ser. No. 11/037,214, filed Jan. 19, 2005, describes a toner comprising a toner binder comprised of crystalline sulfonated polyester, wherein the crystalline sulfonated polyester comprises 90% by weight or more of the toner binder, and a colorant. The entire disclosure of this application is totally incorporated herein by reference.

Application Ser. No. 11/094,428, filed Mar. 31, 2005, describes a method, comprising forming a mixture of sulfonated polyester resin, a colorant dispersion and optionally a wax dispersion, homogenizing the mixture, adding a coagulant to the mixture and aggregating the mixture to form aggregated particles, and coalescing the aggregated particles to form coalesced particles, wherein when a predetermined average particle size is achieved during the aggregation and/or coalescing step, a complexing agent that complexes with ions of the coagulant is added in an amount effective to substantially halt any further particle growth. The entire disclosure of this application is totally incorporated herein by reference.

In embodiments herein, there can be selected for the present disclosure a number of the components and processes of the copending applications, such as for example, the toner binder and other toner components, processes of making toner and processes of using toner in forming an image.

BACKGROUND

Described herein are toners comprised of a sulfonated polyester resin and at least one colorant. Also described are processes for the preparation of toners. The toners may be selected for a number of electrophotographic imaging methods and/or printing processes, including color processes, digital systems and processes, and lithography.

The toner in embodiments is comprised of a sulfonated polyester resin in which the amounts of metals therein are specified. An advantage to limiting the amounts of metals in the toner to such specified amounts is that an end toner has substantially suitable fusing and electrical performance properties, for example fusing and electrical performance properties appropriate for the device with which the toner will be used in forming images.

REFERENCES

Alkali metal sulfonated polyester resins, for example for use as a binder in a toner composition, are known. Emulsion aggregation processes for making toners using such resins are also known. The aggregating agent used in such processes may be comprised of a metal salt. The toner comprised of the alkali metal sulfonated polyester resin binder thus will include several metal ions therein, for example from the alkali metal of the resin and from unused amounts of the aggregating agent remaining in the end toner. The presence of these metal ions may adversely affect the fusing performance and electrical performance of the toner.

U.S. Pat. No.5,593,807 describes a process for the preparation of toner compositions comprising: (i) preparing an emulsion latex comprised of sodio sulfonated polyester resin particles of from about 5 to about 500 nanometers in size diameter by heating said resin in water at a temperature of from about 65° C. to about 90° C. (ii) preparing a pigment dispersion in a water by dispersing in water from about 10 to about 25 weight percent of sodio sulfonated polyester and from about 1 to about 5 weight percent of pigment; (iii) adding the pigment dispersion to a latex mixture comprised of sulfonated polyester resin particles in water with shearing, followed by the addition of an alkali halide in water until aggregation results as indicated by an increase in the latex viscosity of from about 2 centipoise to about 100 centipoise; (iv) heating the resulting mixture at a temperature of from about 45° C. to about 80° C. thereby causing further aggregation and enabling coalescence, resulting in toner particles of from about 4 to about 9 microns in volume average diameter and with a geometric distribution of less than about 1.3; and optionally (v) cooling the product mixture to about 25° C., followed by washing and drying.

U.S. Pat. No. 5,919,595 describes a process for the preparation of toner comprising mixing an emulsion latex, a colorant dispersion, and monocationic salt, and which mixture possesses an ionic strength of from about 0.001 molar (M) to about 5 molar, and optionally cooling.

U.S. Pat. No. 6,020,101 describes a toner comprised of a core comprised a first resin and colorant, and thereover a shell comprised of a second resin, and wherein the first resin is an ion complexed sulfonated polyester resin, and the second resin is a transition metal ion complex sulfonated polyester resin.

U.S. Pat. No. 6,780,560 describes a process involving, for example, the admixing of an emulsion latex, a colorant, and a tetra-alkylated quaternary ammonium halide salt complexing agent; and thereafter, heating in sequence about below the Tg of a resin contained in the latex and then heating about above the Tg glass transition temperature of a resin contained in the latex.

U.S. Pat. No. 6,824,944 describes a toner process involving, for example, contacting a toner surface with a reducing agent and a metal halide.

The entire disclosure of each of the above-mentioned references is totally incorporated herein by reference.

SUMMARY

In embodiments, toners comprised of a sulfonated polyester resin and at least one colorant, wherein the toner contains, for example, from about 0.01% by weight to about 3% by weight of dry toner in total of metals such as lithium, sodium, zinc and calcium, are described.

In further embodiments there is disclosed toners comprised of an alkali metal sulfonated polyester resin and at least one colorant, wherein the toner contains from about 0% to about 0.1% by weight of dry toner of calcium, from about 0.1% to about 1.5% by weight of the dry toner of zinc, and from about 0.01% to about 0.5% by weight of the dry toner of sodium and lithium.

Also, in embodiments there is disclosed a process comprising preparing a colloidal solution of an alkali metal sulfonated polyester resin, adding to the colloidal solution a colorant, heating to a temperature of from about 45° C. to about 80° C., adding an aqueous solution of an alkali metal salt, and aggregating the mixture to form toner particles, wherein the toner contains from about 0.01% by weight to about 3% by weight of dry toner in total of lithium, sodium, zinc and calcium.

EMBODIMENTS

In embodiments, described is a toner comprising a sulfonated polyester, or sulfopolyester, resin and at least one colorant, wherein the toner contains a reduced amount of metal, for example from about 0.01% by weight to about 3% by weight, such as from about 0.1% to about 2% by weight or from 0.1% to about 1% by weight, of dry toner in total of metals including lithium, sodium, zinc and calcium.

Thus, in embodiments, the binder of the toner particles is comprised of a polyester resin, for example a sulfonated polyester resin, more specifically an alkali metal sulfonated polyester resin such as a sodium and/or lithium sulfonated polyester resin.

In embodiments herein, sulfonated refers, for example, to a polyester resin containing a sulfur atom, such as a sulfo group, for example a —$SO_3$ group and the like. In embodiments, the sulfonated polyesters may have the following general structure, or random copolymers thereof in which the n and p segments are separated:

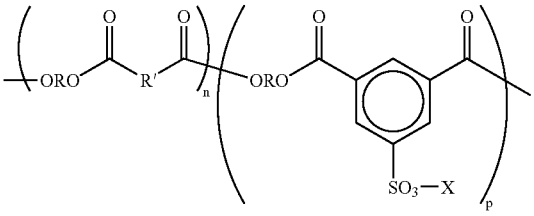

wherein in the formula, R may be an alkylene of, for example, from about 2 to about 25 carbon atoms, such as from about 2 to about 20 carbon atoms or from about 2 to about 10 carbon atoms, such as ethylene, propylene, butylene, oxyalkylene diethyleneoxide and the like, R' may be an arylene of, for example, from about 6 to about 36 carbon atoms, such as from about 6 to about 20 carbon atoms or fro about 6 to about 15 carbon atoms, such as a benzylene, bisphenylene, bis(alkyloxy) bisphenolene and the like, wherein the variables p and n represent the number of randomly repeating segments, such as for example from about 10 to about 100,000, for example from about 100 to about 50,000 or from about 1,000 to about 50,000, and X represents an alkali metal such as sodium, lithium, potassium, any combinations thereof, and the like.

In embodiments, R may be ethylene, propylene, dipropylene or a combination thereof, R' may be benzylene, bisphenylene or a combination thereof, and X may be lithium, sodium or a combination thereof. More specifically, R may be propylene and/or dipropylene, R' may be benzylene and X may be sodium.

The sulfonated polyester may be an alkali metal sulfonated polyester, more specifically a lithium sulfonated polyester, a sodium sulfonated polyester, or a combination thereof.

In further embodiments, the sulfonated polyester may be amorphous, including both branched (crosslinked) and linear, crystalline, or a combination of the foregoing. The sulfonated polyester thus may possess a number of characteristics, such as being low melt or ultra low melt, which for example refers to exhibiting, when fused using a heated fuser roll, a minimum fixing temperature (MFT) of from about 60° C. to about 200° C., from about 80° C. to about 160° C. or from about 80° C. to about 140° C.

The linear amorphous sulfopolyester selected may have a number average molecular weight (Mn) of from about 1,000 to about 100,000, for example from about 1,000 to about 50,000 or from about 5,000 to about 50,000, grams per mole and a weight average molecular weight (Mw) of from about 2,000 to about 150,000, for example from about 2,000 to about 100,000 or from about 10,000 to about 100,000, grams per mole as measured by gel permeation chromatography (GPC) and using polystyrene standards. A branched amorphous polyester resin, in embodiments, may possess, for example, a number average molecular weight (Mn), as measured by GPC, of from about 5,000 to about 500,000, for example from about 5,000 to about 250,000 or from about 25,000 to about 250,000, a weight average molecular weight (Mw) of, for example, from about 7,000 to about 600,000, for example from about 10,000 to about 300,000 or from about 20,000 to about 300,000, as determined by GPC using polystyrene standards. The molecular weight distribution (Mw/Mn) is, for example, from about 1.5 to about 6, and more specifically, from about 2 to about 4. The onset glass transition temperature (Tg) of the resin as measured by a differential scanning calorimeter (DSC) is, in embodiments, for example, from about 55° C. to about 70° C., and more specifically, from about 55° C. to about 67° C.

In embodiments, the crystalline sulfonated polyester resin may comprise from about 0% to about 100% by weight of the binder, for example including from about 20% to about 90% by weight or from about 20% to about 50% by weight of the binder, and the amorphous sulfonated polyester resin may comprise from about 0% to about 100% by weight of the binder, for example including from about 20% to about 90% by weight or from about 20% to about 80% by weight of the binder. In general, the greater the amount of crystalline sulfonated polyester resin in the binder, the lower the melting temperature of the toner and thus the lower the temperature required for fusing of the toner.

Examples of amorphous, linear and/or branched, sulfonated polyester resins include copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(5-sulfo-isophthalate-1,3-propylene/dipropylene)-copoly(1,3-propylene/dipropylene-terephthalate), copoly(propylene-butylene-terephthalate)-copoly(propylene-butylene-5-sulfo-isophthalate), copoly(propoxylated bisphenol-A-furmarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate). The alkali metal forms of the sulfonated polyesters may have the alkali metal as, for example, a sodium, lithium and/or potassium ion.

Crystalline sulfonated polyester refers in embodiments to, for example, a sulfonated polyester polymer having a three dimensional order. Crystalline refers more specifically to a sulfonated polyester having a degree of crystallinity, for example including semicrystalline and fully crystalline sulfonated polyester materials. A sulfonated polyester having therein crystals with a regular arrangement of its atoms in a space lattice may be considered crystalline.

Examples of crystalline sulfonated polyester based resins copoly(5-sulfoisophthaloyl)-co-poly(ethylene-adipate), alkali copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-iosphthaloyl)-copoly(octylene-adipate), copoly(5-sulfo-isophthaloyl)-copoly(ethylene-adipate), copoly(5-sulfo-isophthaloyl)-copoly (propylene-adipate), copoly(5-sulfo-isophthaloyl)-co-poly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl-copoly(butylenesuccinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylene-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-iosphthaloyl)-copoly(butylene-adipate), copoly(5-sulfo-isophthaloyl)-copoly(pentylene-adipate), and copoly(5-sulfo-isophthaloyl)copoly(hexylene-adipate). The alkali metal forms of the sulfonated polyesters may have the alkali metal as, for example, a sodium, lithium and/or potassium ion. Of course, the amorphous and crystalline sulfonated polyester resins may be comprised of the same or different sulfonated polyester resins.

In addition to the binder, the toner particles further include at least one colorant. Various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

Optionally, the toner particles may also include a wax. When included, the wax may be present in an amount of from, for example, about 1 weight percent to about 25 weight percent, or from about 5 weight percent to about 20 weight percent, of the toner particles.

Waxes that may be selected-include waxes with, for example, a weight average molecular weight of from about 500 to about 20,000, in embodiments from about 500 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures of waxes may also be used. Waxes may be included as, for example, fuser roll release agents.

The toner particles in embodiments may also contain other optional additives, as desired or required. For example, the toner may include positive or negative charge enhancing additives, for example in an amount of about 0.1 to about 10, such as about 1 to about 3, percent by weight of the toner. Examples of these additives include quaternary ammonium compounds inclusive of alkyl pyridinium halides; bisulfates; alkyl pyridinium compounds, reference U.S. Pat. No. 4,298,672, the disclosure of which is totally incorporated hereby by reference; organic sulfate and sulfonate compositions, reference U.S. Pat. No. 4,338,390, the disclosure of which is totally incorporated hereby by reference; cetyl pyridinium tetrafluoroborates; distearyl dimethyl ammonium methyl sulfate; aluminum salts such as BONTRON E84™ or E88™ (Hodogaya Chemical); mixtures thereof and the like.

In embodiments, the toner particles can be comprised of a core-shell composite structure with a core encapsulated or surrounded by a shell. In such embodiments, the core may be comprised of the sulfonated polyester resin, the colorant, the wax, and the like as discussed above. The shell may then be comprised of additional sulfonated polyester resin, and for example includes substantially only the additional sulfonated polyester resin therein. The additional sulfonated polyester resin of the shell may be the same as or different from the sulfonated polyester resin of the core, including for example both the core and shell sulfonated polyester resins having the same sulfonated polyester resin structure but being salts of different metals. Further, in embodiments, the shell sulfonated polyester resin may be made to have a higher glass transition temperature (Tg) than the sulfonated polyester resin of the core in order to assist in prevent blocking, that is, clumping of the toner such as may occur in higher temperature and/or higher humidity environments without the higher Tg shell. If present, the shell sulfonated polyester resin may be added in an amount of from about 5% to about 60%, for example about 5% to about 30%, by weight of the toner. The shell may have a thickness of about 0.2 to about 1.5 μm, for example about 0.5 to about 1.0 μm.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal silicas, such as AEROSIL®, metal salts and metal salts of fatty acids inclusive of zinc stearate, aluminum oxides, cerium oxides, and mixtures thereof. Each of the external additives may be present in an amount of from about 0.1 percent by weight to about 5 percent by weight, and more specifically, in an amount of from about 0.1 percent by weight to about 1 percent by weight, of the toner. Several of the aforementioned additives are illustrated in U.S. Pat. Nos. 3,590,000 and 6,214,507, the disclosures of which are totally incorporated herein by reference.

In the toner, the amounts of the metals therein can be controlled to achieve acceptable or improved xerographic performance, such as acceptable or improved fusing and electrical performance. Metals may be introduced into the toner in a variety of ways. For alkali metal sulfonated polyester resins, such resins contain an amount of alkali metal, for example an amount of lithium and/or sodium. In addition, in embodiments the toners are prepared via an emulsion aggregation process in which a coagulant or aggregating agent comprised of a metal salt such as a zinc salt, for example zinc acetate, or a calcium salt, for example calcium chloride, is used. Unused undesirable amounts of the metal salt aggregating agent may remain in the dry toner.

In embodiments, the amount of such metals in the dry toner, that is the toner following any drying procedure, for example as occurs following aggregation, coalescence and/or drying of the toner, and exclusive of any external surface additives, is, for example, from about 0.01% by weight to about 3% by weight, such as from about 0.1% to about 2% by weight or from 0.1% to about 1% by weight, of dry toner in total of lithium, sodium, zinc and calcium. For each of these metals, the toner may contain from about 0% to about 0.1% by weight of the dry toner of calcium, from about 0.1% to about 3% by weight of the dry toner of zinc, from about 0% to about 1% by weight of the dry toner of sodium and from about 0% to about 1% by weight of the dry toner of lithium. More specifically, the toner may contain from about 0% to about 0.1% by weight of the dry toner of calcium, from about 0.1% to about 1.5% by weight of the dry toner of zinc, and from about 0.01% to about 0.5% by weight of the dry toner of sodium and lithium, for example from about 0% to about 0.05% by weight of the dry toner of calcium, from about 0.5% to about 1.5% by weight of the dry toner of zinc, and from about 0.01% to about 0.3% by weight of the dry toner of sodium and lithium.

The dry toner particles, exclusive of external surface additives, may have an average particle size of about 3 to about 25 micrometers, from about 5 to about 15 micrometers, or about 5 to about 10 micrometers, with a geometric size distribution (GSD) (number and/or volume) of, for example, about 1.05 to about 1.35, such as about 1.10 to about 1.30 or about 1.15 to about 1.25. Herein, the geometric size distribution refers, for example, to the square root of D84 divided by D16, and is measured by a Coulter Counter. The particle diameters at which a cumulative percentage of, for example, 16 percent of particles are attained, refer to the volume and/or number D16 percent, and the particle diameters at which a cumulative percentage of 84 percent are attained are referred to as volume and/or number D84.

Also, in embodiments, the toners may be prepared by the known aggregation and coalescence process in which an emulsion of small size resin particles are aggregated to the appropriate toner particle size and then optionally coalesced to achieve the final toner particle shape and morphology.

The toners may thus be prepared by a process that includes aggregating a mixture of a colorant, optionally a wax and any other desired or required additives, and emulsion(s) comprising the sulfonated polyester resin(s), and then optionally coalescing the aggregated particles.

In embodiments, a method of making the toner particles including the sulfonated polyester resin, comprises admixing a colloidal solution of an alkali metal sulfonated polyester resin and colorant, and adding thereto an aqueous solution containing an alkali (II) salt of the polyester resin and optionally cooling and optionally adding to the toner wax, charge additives, and/or surface flow additives. For example, the toner may be formed in a process comprising preparing a colloidal solution of an alkali metal sulfonated polyester resin by heating the solution at a temperature of from about 75 to about 95° C., adding thereto an alkali metal sulfonated polyester, cooling, adding thereto a colorant, followed by heating the resulting mixture and adding thereto an aqueous solution containing an alkali (II) metal salt (divalent salt), adding a further amount of colloidal sulfonated polyester resin, followed by the addition of an aqueous solution of a transition metal salt solution, isolating the resulting toner, optionally washing with water, and drying the toner. More specifically, the process may comprise heating a mixture of a colorant and an aqueous solution of a polyester, especially an alkali metal sulfonated polyester colloid with a particle size of from about 10 to about 80 nm, for example from about 10 to about 40 nm; heating the resulting mixture to a suitable temperature of, for example, about 45 to about 80° C. and adding thereto an aqueous solution of an alkali (II) salt such as magnesium chloride and the like, thereby forming a core particle comprised of a colorant and first resin comprised of an ionically complexed alkali (II) sulfonated polyester, with a particle size of from about 2 to about 7 μm in volume average diameter as measured by the Coulter Counter; and adding thereto an aqueous solution containing about 10 to about 35 percent by weight of alkali metal sulfonated polyester resin colloid, and an aqueous solution containing from about 1 to about 10 percent by weight of coalescence agent, for example comprised of a metal salt of the transition metals of Groups III to XII, such as for example, the chloride, acetate, or sulfates of zinc, copper, cadmium, manganese, vanadium, nickel, niobium, chromium, iron, zirconium, scandium and the like. Or the process may comprise a first aggregation and/or coalescence of an aqueous dispersion of an alkali metal sulfonated polyester colloid and colorant particles with an alkali (II) salt, such as for example zinc acetate, followed thereafter by a second aggregation and/or coalescence of the aforementioned core particles and an alkali metal sulfonated polyester colloid and an aggregation/coalescence agent comprised of a metal salt of the transition metals of Groups III to XII, such as for example, the chloride, acetate, or sulfates of zinc, scandium and the like.

In an example method generating a core-shell structured toner, the method may comprise (i) generating a colloidal solution of an alkali metal sulfonated polyester resin, present for example in an amount of from about 500 grams in 2 liters of water, by heating the mixture at, for example, from about 20° C. to about 40° C. above the polyester polymer glass transition temperature, and thereby forming a colloidal solution of submicron particles in the size range of, for example, from about 5 to about 40 nm; (ii) adding thereto a colorant in an amount of for example, from about 3 to about 5 percent by weight of toner; (iii) heating the mixture to a temperature of from about 45° C. to about 80° C. such as from about 50° C. to about 70° C., and adding thereto an aqueous solution of an alkali salt, such as zinc acetate (for example, at about 2 percent by weight in water), at a rate of from about 0.5 to about 5 mL per minute such as from about 1 to about 2 mL per minute, whereby the coalescence and aggregation (e.g., ionic complexation) of polyester colloid and colorant occur until the particle size of the core composite is, for example, from about 3 to about 12 μm in diameter such as from about 3 to about 7 μm in diameter (volume average throughout unless otherwise indicated or inferred), with a geometric distribution (GSDv) of from about 1.15 to about 1.23 as measured by the Coulter Counter; (iv) adding thereto a colloidal solution of a sulfonated polyester resin, for example, of from about 10 to about 25 percent by weight of toner, followed by the addition of an alkali salt, such as for example at about 5% percent by weight in water, at a rate of from about 2 to about 4 mL per minute, thereby resulting in the aggregation and/or coalescence of the polyester colloid onto the core composite and forming thereover a second polyester resin shell; followed by (v) cooling the reaction mixture to about room temperature (such as about 20° C. to about 26° C.), filtering, optionally washing with water, and drying. A toner is derived comprised of a core comprised of a colorant and a first polyester resin, and thereover a shell comprised of a second polyester resin, and wherein the particle size of the toner composite is from about 3 to about 15 microns in diameter, such as from about 3 to about 10 microns or from about 5 to about 15 microns, with a geometric distribution of from about 1.10 to about 1.30 such as from about 1.15 to about 1.25 or from about 1.15 to about 1.23 as measured by the Coulter Counter.

The resin may be heated in water to a temperature of for example from about 75 to about 95° C. with stirring to form an aqueous dispersion of the alkali metal sulfonated polyester resin colloid in water, with a colloid solids content of from, for example, about 5 to about 35 percent by weight of water, and preferably from about 12 to about 20 percent by weight of water.

As the alkali (II) metal salts that can be selected to aggregate and coalesce the generated alkali metal sulfonated polyester colloid with a colorant to enable the formation of the core composite, mention may be made of the alkali (II) groups such as beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, zinc acetate or mixtures thereof. The concentration thereof may be in the range of for example from about 0.1 to about 5 weight percent of water. It is believed that the divalent alkali (II) metal ion exchanges with the monovalent alkali metal (for example, sodium or lithium) ion of the sulfonated polyester resin colloid, thus coalescing the colloidal particles.

Examples of transition metal salts that can be selected to coalesce the alkali metal sulfonated polyester colloid to form a second polyester resin shell include, for example, halides such as chloride, bromide, iodide, or anions such as acetates, acetoacetates, sulfates of vanadium, niobium, tantalum, chromium, molybdenum, tungsten, manganese, iron, ruthenium, cobalt, nickel, copper, zinc, cadmium, silver; aluminum salts such as aluminum acetate, aluminum polyaluminum chloride, aluminum halides, mixture thereof and the like. In embodiments, the agent is a zinc salt such as zinc acetate, a calcium salt such as calcium chloride, or a combination thereof. The concentration thereof may optionally be in the range of from about 0.1 to about 5 weight percent by weight of water. It is believed, while not being desired to be limited by theory throughout, that the transition metal ion exchanges with the monovalent alkali metal ion of the sulfonated polyester resin colloid, thus coalescing the colloidal particles.

The salt agent may be added to the mixture in an amount of, for example, from about 0.1% to about 5% by weight, for example from about 0.1% to about 3% or from about 0.5% to about 5% by weight, of the resin in the mixture. This provides a sufficient amount of agent for aggregation and coalescence while limiting the amount of unused metal ions that will remain in the dry toner.

In order to control aggregation and coalescence of the particles, in embodiments the salt agent may be metered into the mixture over time as indicated above. For example, the agent may be metered into the mixture over a period of from about 5 to about 240 minutes such as from about 30 to about 200 minutes, although more or less time may be used as desired or required. The addition of the agent may also be done while the mixture is maintained under stirred conditions (such as from about 50 to about 1,000 rpm, for example from about 100 to about 500 rpm) and elevated temperature (such as from about 45° C. to about 80° C. as discussed above).

The particles are permitted to aggregate and/or coalesce until a predetermined desired particle size is obtained. A predetermined desired size refers to the desired particle size to be obtained being determined prior to formation, and the particle size being monitored during the growth process until such particle size is reached. Samples may be taken during the growth process and analyzed, for example with a Coulter Counter, for average particle size. The aggregation/coalescence thus may proceed by maintaining the elevated temperature, or slowly raising the temperature to, for example, about 65° C., and holding for about 0.5 to about 6 hours, for example for about 1 to about 6 hours, while maintaining stirring, to provide the aggregated particles. Once the predetermined desired particle size is reached, then the growth process is halted. In embodiments, the predetermined desired particle size is within the toner particle size ranges mentioned above.

During the aggregation, for example after a certain predetermined size for the core particles is reached and if it is desired to form a shell on the core aggregated particles, additional binder latex containing the additional sulfonated polyester resin for the shell, may be added to form the shell upon the aggregated core particles. Aggregation may then continue until the shell is formed upon the aggregated core particles.

The growth and shaping of the particles following addition of the coagulant may be accomplished under any suitable conditions. For example, the growth and shaping is conducted under conditions in which aggregation occurs separate from coalescence. For separate aggregation and coalescence stages, the aggregation step may be conducted under shearing conditions at an elevated temperature, for example of from about 45° C. to about 70° C., such as from about 45° C. to about 66° C. Following aggregation to the desired particle size, the particles may then be coalesced to the desired final shape, the coalescence being achieved by, for example, heating the mixture to a temperature of from about 55° C. to about 95° C. or from about 60° C. to about 85° C., and/or increasing the stirring, for example to about 400 rpm to about 1,000 rpm such as from about 500 rpm to about 800 rpm. Of course, higher or lower temperatures may be used, it being understood that the temperature is a function of the resins used for the binder. Coalescence may be accomplished over a period of from about 0.1 to about 9 hours, for example from about 0.1 to about 4 hours.

After coalescence, the mixture is cooled to room temperature, such as from about 20° C. to about 26° C. The cooling may be rapid or slow, as desired. A suitable cooling method may comprise introducing cold water to a jacket around the reactor. After cooling, the toner particles are optionally washed with water, and then dried. Drying may be accomplished by any suitable method for drying, including for example freeze-drying. Freeze drying may be accomplished at temperatures of about −50° C. to about −100° C. such as about −80° C. for a period of about 72 hours.

Following formation of the toner particles, the aforementioned external additives may be added to the toner particle surface by any suitable procedure such as those known in the art.

The toners can be selected for electrostatographic or xerographic processes, reference for example, U.S. Pat. No. 4,265,990, incorporated herein by reference in its entirety. The toners may exhibit a number of satisfactory properties when used in a xerographic or electrostatographic process, such as excellent C-zone (10° C./ 15% relative humidity) and A-zone (28° C./85% relative humidity) charging, a fusing latitude of at least about 100° C., for example up to about 300° C. or more, such as from about 100° C. to about 200° C., and substantially no vinyl offset.

The toner particles may be formulated into a developer composition. The toner particles may be mixed with carrier particles to achieve a two-component developer composition. The toner concentration in the developer may range from, for example, about 1% to about 25%, such as about 2% to about 15%, by weight of the total weight of the developer.

Examples of carrier particles that can be selected for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326.

The selected carrier particles can be used with or without a coating. In one embodiment, the carrier particles are comprised of a core with coating thereover generated from a mixture of polymers that are not in close proximity thereto in the triboelectric series. The coating may be comprised of fluoropolymers, such as polyvinylidene fluoride resins, terpolymers of styrene, methyl methacrylate, and a silane, such as triethoxy silane, tetrafluoroethylenes, other known coatings and the like. For example, coating containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate may be mixed in proportions of from about 30 to about 70 wt. % to about 70 to about 30 wt. %, in embodiments from about 40 to about 60 wt. % to about 60 to about 40 wt. %. The coating may have a coating weight of from, for example, about 0.1 to about 5% by weight of the carrier, such as about 0.5 to about 2% by weight. The PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with from, for example, about 0.05 to about 10 percent by weight, such as about 0.05 percent and about 3 percent by weight, based on the weight of the coated carrier particles, of polymer until adherence thereof to the carrier core by mechanical impaction and/or electrostatic attraction. Various effective suitable means can be used to apply the polymer to the surface of the carrier core particles, for example, cascade roll mixing, tumbling, milling, shaking, electrostatic powder cloud spraying, fluidized bed, electrostatic disc processing, and with an electrostatic curtain. The mixture of carrier core particles and polymer is then heated to enable the polymer to melt and fuse to the carrier core particles. The coated carrier particles are then cooled and thereafter classified to a desired particle size.

An exemplary suitable carrier is a steel core, for example of about 25 to about 100 μm in size, in embodiments from about 50 to about 75 μm in size, coated with about 0.5% to about 10% by weight, in embodiments from about 0.7% to about 5% by weight, such as about 1% by weight, of a conductive polymer mixture comprised of, for example, methylacrylate and carbon black using the process described in U.S. Pat. No. 5,236,629 and U.S. Pat. No. 5,330,874.

The carrier particles can be mixed with the toner particles in various suitable combinations. The concentrations are usually about 1% to about 20% by weight of toner and about 80% to about 99% by weight of carrier. However, different toner and carrier percentages may be used to achieve a developer composition with desired characteristics.

In embodiments, any known type of image development system may be used in an image developing device, including, for example, magnetic brush development, jumping single-component development, hybrid scavengeless development (HSD), etc. These development systems are known in the art. Once the image is formed with toners/developers via a suitable image development method such as any one of the aforementioned methods, the image is then transferred to an image receiving medium such as paper and the like. In embodiments, the toners may be used in developing an image in an image-developing device utilizing a fuser roll member. Fuser roll members are contact fusing devices that are known in the art, in which heat and pressure from the roll are used in order to fuse the toner to the image-receiving medium. Typically, the fuser member may be heated to a temperature just above the fusing temperature of the toner, for example to temperatures of from about 80° C. to about 150° C. or more.

EXAMPLE 1

185.8 kg of dimethyl terephthalate, 23.1 kg of sodium sulfoisophthalic, 147.1 kg of propylene glycol, 64.8 kg of dipropylene glycol and 0.48 kg of FASCAT-4100 (butyltin oxide catalyst from Elf Atochem North America, Inc.) were charged in a 150 gallon stainless steel reactor. The mixture was agitated at 80 rpm using two P2 45 degree angle blades. The reactor was then heated to 180° C. where it was held to remove the distillate. Approximately 12 kg of distillate was collected in approximately one hour. In order to achieve a gradual removal of the distillate, the reactor temperature was gently stepped up from 180° C. to 210° C. and finally to 220° C. so that all the distillate from the esterification stage could be removed. A total of 60.4 kg of distillate was collected as distillate in five hours.

In the subsequent polycondensation stage, a vacuum was applied to remove excess glycol from the reaction. The pressure was slowly reduced from atmospheric to about 8 mm Hg over a 3.5 hour period. The vacuum was held at these elevated temperatures for an additional 2.5 hours. A total of 112.6 kg of distillate was collected in a distillation receiving tank. The reactor was then purged with nitrogen to atmospheric pressure, and the hot molten polyester product was discharged through the bottom drain onto a container cooled with dry ice to yield 245.8 kg of a 3.77 mol percent sulfonated polyester resin, sodio salt of (1,2-propylene-dipropylene-5-sulfoisophthalate)-copoly(1,2-propylene-dipropylene terephthalate).

The sulfonated polyester resin glass transition temperature was measured to be 57.7° C. (onset) using the 910 Differential Scanning Calorimeter operating at a heating rate of 10° C. per minute.

The polyester resin was then fritz milled into smaller particle sizes for emulsion preparation. A 24 percent of aqueous colloidal sulfonate polyester resin was prepared by first heating 542 grams of deionized water to 90° C. with stirring, and then adding thereto 174 grams of the sulfonated polyester resin obtained above. The temperature and stirring of the mixture was continued for a duration of 3 hours. Then it was cooled and filtered through a 20 micron stainless steel screen (#625 mesh). A sample is taken and measured by the Microtrac particle sizer to have a D50 of approximately 27 nanometers.

EXAMPLE 2

In this Example, an 8.5 μm cyan toner is prepared. A 2 liter Büchi reactor equipped with a mechanical stirrer containing two P4 45 degree angle blades was charged with 715.5 grams of 24 percent by weight of 3.75% sodio-sulfonated polyester resin (Tg=57.7° C.) as described in Example 1, and 17.5 grams of a cyan pigment dispersion containing 48.6 percent by weight of Pigment Blue 15:3 (made as a FLEXIVERSE dispersion). An additional 264.7 g of deionized water was added to the slurry, making the overall toner solids in the final slurry to equal 12%. The reactor was heated to 66° C. at 1° C. per minute with stirring at 300 revolutions per minute. Once at 66° C., 3.0% wt. zinc acetate dehydrate solution (20.86 g zinc acetate dehydrate in 674.32 g deionized water) was metered into the reactor via a positive displacement pump over 180 minutes. Once all the zinc acetate dehydrate solution was added the $D_{50}$ and GSD (by volume) were measured to be 6.97 micron and 1.23, consecutively, with the Coulter Counter Particle Size Analyzer. After 60 minutes at 66° C., the $D_{50}$ particle size of the toner had already reached 8.5 micron, but as aggregates and not coalesced particles. The particle circularity was measured using the Flow Particle Image Analyzer (FPIA) to be 0.934. At this point, the mixing was increased to 500 revolutions per minute and held for 20 minutes. At the end of the 20 minutes, a sample was taken and measured as having a D50 and circularity of 8.5 micron and 0.970, respectively. The reaction was then cooled at 2° C. per minute and the final D50 particle size, GSD (by volume) and circularity was measured to be 8.7 micron, 1.21 and 0.975, respectively. The product was filtered through a 25 micron stainless steel screen (#500 mesh), left in its mother liquor and settled overnight. The next day, the mother liquor, which was clear, was decanted from the toner cake that settled to the bottom of the beaker. The settled toner was reslurried in 1.5 liter of deionized water, stirred for 30 minutes, and then vacuum filtered with a 3 micron nominal filter paper. This procedure was repeated once more until the solution conductivity of the filtrate was measured to be about <30 microsiemens per centimeter, which indicated that the washing procedure was sufficient. The toner cake was redispersed into 300 milliliters of deionized water, and freeze-dried over 72 hours. The final dry yield of toner was estimated to be 90% of the theoretical yield.

EXAMPLE 3

In this Example, an 8.5 μm cyan toner is prepared using calcium chloride. A 2 liter Büchi reactor equipped with a mechanical stirrer containing two P4 45 degree angle blades was charged with 715.5 grams of 24 percent by weight of 3.75% sodio-sulfonated polyester resin (Tg=57.7° C.) as described in Example 1, 17.5 grams of a cyan pigment dispersion containing 48.6 percent by weight of Pigment Blue 15:3 (made as a FLEXLVERSE dispersion), and 5.42 grams of 1% wt. solution of calcium chloride. An additional 264.7 g of deionized water was added to the slurry, making the overall toner solids in the final slurry to equal approximately 12%. The reactor was heated to 66° C. at 1° C. per minute with stirring at 300 revolutions per minute. Once at 66° C., 3.0% wt. zinc acetate dehydrate solution (20.86 g zinc acetate dehydrate in 674.32 g deionized water) was metered into the reactor via a positive displacement pump over 180 minutes. Once all the zinc acetate dehydrate solution was added, the D50 and GSD (by volume) were measured to be 7.12 micron and 1.23, respectively, with the Coulter Counter Particle Size Analyzer. After 60 minutes at 66° C., the D50 particle size of the toner had already reached 8.7 micron, but as aggregates and not coalesced particles. The particle circularity was measured using the Flow Particle Image Analyzer (FPIA) to be 0.933. At this point, the mixing was increased to 500 revolutions per minute and held for 20 minutes. At the end of the 20 minutes, a sample was taken and measured as having a D50 and circularity of 8.7 micron and 0.97 1, respectively. The reaction was then cooled at 2° C. per minute and the final D50 particle size, GSD (by volume) and circularity was measured to be 8.8 micron, 1.21 and 0.973, respectively. The product was filtered through a 25 micron stainless steel screen (#500 mesh), left in its mother liquor and settled overnight. The next day, the mother liquor, which was clear, was decanted from the toner cake that settled to the bottom of the beaker. The settled toner was reslurried in 1.5 liter of deionized water, stirred for 30 minutes, and then vacuum filtered with a 3 micron nominal filter paper. This procedure was repeated once more until the solution conductivity of the filtrate was measured to be about <30 micro siemens per centimeter, which indicated that the washing procedure was sufficient. The toner cake was redispersed into 300 milliliters of deionized water, and freeze-dried over 72 hours. The final dry yield of toner was estimated to be 90% of the theoretical yield.

The emulsion aggregation toners of Examples 2 and 3 were analyzed for metal content using ICP. Inductively Coupled Plasma (ICP) is an analytical technique used for the detection of trace metals in an aqueous solution. The primary goal of ICP is to get elements to emit characteristic wavelength specific light that can then be measured. The light emitted by the atoms of an element in the ICP must be converted to an electrical signal that can be measured quantitatively. This is accomplished by resolving the light into its component radiation (nearly always by means of a diffraction grating) and then measuring the light intensity with a photomultiplier tube at the specific wavelength for each element line. The light emitted by the atoms or ions in the ICP is converted to electrical signals by the photomultiplier in the spectrometer. The intensity of the electron signal is compared to previous measured intensities of known concentrations of the element, and a concentration is computed. Each element will have many specific wavelengths in the spectrum that could be used for analysis. The results are shown in Table 1 for sodium, zinc and calcium content of the toner particles.

TABLE 1

| | Na (weight percent) | Zn (weight percent) | Ca (ppm) |
|---|---|---|---|
| Example 2 | 0.05 | 0.923 | None |
| Example 3 | 0.011 | 1.085 | 300 |

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are intended to be emcompassed by the following claims.

What is claimed is:

1. A toner comprised of a sulfonated polyester resin and at least one colorant, wherein the toner contains from about 0% to about 0.1% by weight of dry toner of calcium, from about 0.1% to about 1.5% by weight of the dry toner of zinc, and from about 0.01% to about 0.5% by weight of the dry toner of sodium and lithium.

2. The toner according to claim 1, wherein the sulfonated polyester resin is of the formula

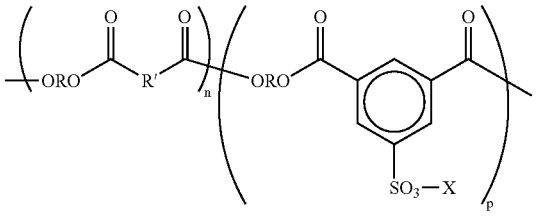

wherein R is an alkylene, R' is an arylene, p and n represent the number of repeating segments and X is an alkali metal.

3. The toner according to claim 2, wherein R is an alkylene of from about 2 to about 25 carbon atoms, R' is an arylene of from about 6 to about 36 carbon atoms, and p and n are each from about 10 to about 100,000.

4. The toner according to claim 2, wherein the sulfonated polyester resin is a random copolymer of the formula in which the n and p segments are separated.

5. The toner according to claim 2, wherein R is ethylene, propylene, dipropylene or combinations thereof, R' is benzylene, bisphenylene or combination thereof, and X is lithium, sodium or a combination thereof.

6. The toner according to claim 1, wherein the sulfonated polyester resin is linear amorphous, branched amorphous, crystalline or a combination thereof.

7. The toner according to claim 1, wherein the colorant comprises pigment, dye, mixtures of pigment and dye, mixtures of pigments or mixtures of dyes.

8. The toner according to claim 1, wherein the toner further includes a wax.

9. The toner according to claim 1, wherein the toner further has a core-shell structure, both the core and shell including a sulfonated polyester resin, which may be the same or different, therein.

10. The toner according to claim 1, wherein the toner has an average particle size of about 5 to about 15 microns and a geometric size distribution of about 1.10 to about 1.35.

11. A toner comprising an alkali metal sulfonated polyester resin and colorant, wherein the toner contains from about 0% to about 0.1% by weight of dry toner of calcium, from about 0.1% to about 1.5% by weight of the dry toner of zinc, and from about 0.01% to about 0.5% by weight of the dry toner of sodium and lithium.

12. The toner according to claim 11, wherein the alkali metal of the polyester resin is sodium, lithium or a combination thereof.

13. The toner according to claim 11, wherein the alkali metal sulfonated polyester resin is linear amorphous, branched amorphous, crystalline or a combination thereof.

14. The toner according to claim 11, wherein the colorant comprises pigment, dye, mixtures of pigment and dye, mixtures of pigments or mixtures of dyes.

15. The toner according to claim 11, wherein the toner further includes a wax.

16. The toner according to claim 11, wherein the toner has an average particle size of about 5 to about 15 microns and a geometric size distribution of about 1.10 to about 1.35.

17. A process comprising:

preparing a colloidal solution of an alkali metal sulfonated polyester resin, adding to the colloidal solution a colorant, heating to a temperature of from about 45° C. to about 80° C., adding an aqueous solution of an alkali (II) metal salt, and aggregating the mixture to form toner particles, wherein the toner contains from about 0% to about 0.1% by weight of dry toner of calcium, from about 0.1% to about 1.5% by weight of the dry toner of zinc. and from about 0.01% to about 0.5% by weight of the dry toner of sodium and lithium.

18. The process according to claim 17, wherein the alkali (II) metal salt agent is zinc acetate, calcium chloride or a mixture thereof added in an amount of from about 0.1% to about 5% by weight of the alkali metal sulfonated polyester.

19. The process according to claim 17, wherein after the aggregated toner particles have obtained an average size of from about 3 μm to about 7 μm, the process further comprises adding a colloidal solution of a sulfonated polyester resin followed by the addition of an alkali metal salt to form a shell on the toner particles.

20. An imaging method, comprising forming an image with the toner according to claim 1.

21. An image forming device, wherein the device includes therein the toner according to claim 1 for image formation.

* * * * *